US005117214A

United States Patent [19]

Sturgeon et al.

[11] Patent Number: 5,117,214

[45] Date of Patent: May 26, 1992

[54] INTEGRATED MAGNETIC POWER CONVERTER CORE

[75] Inventors: Clayton L. Sturgeon, Richardson; Paul A. Jeffries, Plano, both of Tex.

[73] Assignee: Powercube Corporation, Billerica, Mass.

[21] Appl. No.: 646,270

[22] Filed: Jan. 28, 1991

[51] Int. Cl.[5] ..... H01F 27/30

[52] U.S. Cl. ..... 336/170; 336/184; 336/221; 336/233

[58] Field of Search ..... 336/184, 221, 233, 234, 336/165, 155, 160, 170, 220, 229; 323/332, 339, 250, 251; 363/16, 20, 49

[56] References Cited

U.S. PATENT DOCUMENTS

| | | | |
|---|---|---|---|
| 1,776,078 | 9/1930 | Mignot | 336/184 |
| 1,880,412 | 10/1932 | Burton | 336/184 |
| 1,995,637 | 3/1935 | Day | 336/233 |
| 2,446,033 | 7/1948 | Wellings | 336/184 |
| 3,418,563 | 12/1968 | Grosu | 336/184 |
| 3,753,189 | 8/1973 | Allen | 336/184 |
| 4,041,431 | 8/1977 | Enoksen | 336/184 |
| 4,821,163 | 4/1989 | Bloom | 363/49 |
| 4,853,668 | 8/1989 | Bloom | 336/170 |
| 4,858,093 | 8/1989 | Sturgeon | 363/20 |
| 4,864,478 | 9/1989 | Bloom | 363/16 |

FOREIGN PATENT DOCUMENTS

| | | | |
|---|---|---|---|
| 908571 | 4/1946 | France | 336/165 |
| 1150272 | 1/1958 | France | 336/184 |
| 1004594 | 9/1965 | United Kingdom | 336/184 |

OTHER PUBLICATIONS

IBM Technical Disclosure Bulletin, "Low Distortion Magnetic Frequency Divider", W. F. Kohlrausch, vol. 16, No. 7, Dec. 1973, pp. 2310, 2311, 336-184.

*Primary Examiner*—Thomas J. Kozma

*Attorney, Agent, or Firm*—Ross, Howison, Clapp & Korn

[57] ABSTRACT

A core for an integrated magnetic power converter includes a continuous magnetic structure having first and second legs and a magnetic flux conducting path therebetween. A primary winding is disposed on the first leg. A first secondary winding is disposed on the first leg. A second secondary winding is disposed on the second leg. The first leg has a cross-sectional area which is greater than the cross-sectional area of the second leg.

1 Claim, 1 Drawing Sheet

INTEGRATED MAGNETIC POWER CONVERTER CORE

TECHNICAL FIELD OF THE INVENTION

This invention relates to power supplies and devices, and more particularly to an integrated magnetic core for a power converter.

BACKGROUND OF THE INVENTION

The combination of an inductive and a transformer element of a power converter on a single core structure is referred to as magnetic integration. The consolidated magnetic system, if integrated properly, has many desired characteristics of an original converter circuit. In many instances, magnetic integration will also produce a converter arrangement which achieves reduced voltage stress on semiconductors and higher efficiency of operation while simultaneously reducing the size and weight of the power converter core. It is desirable to minimize the size and weight of the core while simultaneously maximizing the magnetic field capability. In the design of such cores, it is desirable to optimize the use of the available magnetic material and reduce the size and volume of the core.

A need has thus arisen for a core design having a single winding window, which accommodates two bobbins while minimizing core material.

SUMMARY OF THE INVENTION

In accordance with the present invention, a core for an integrated magnetic power converter is provided. The core includes a continuous magnetic structure having first and second legs and a magnetic flux conducting path therebetween. A primary winding is disposed on the first leg. A first secondary winding is disposed on the first leg. A second secondary winding is disposed on the second leg. The first leg has a cross-sectional area which is greater than the cross-sectional area of the second leg.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
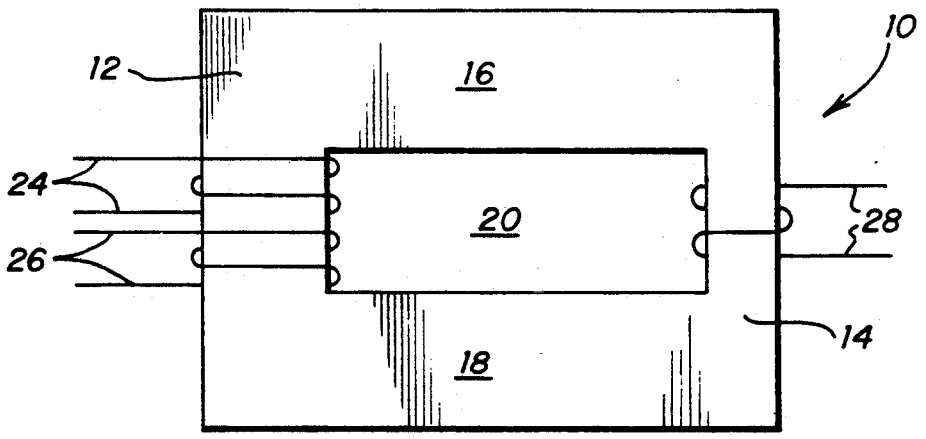
FIG. 1 is a schematic diagram of a first embodiment of the present integrated magnetic power converter core.

Referring to FIG. 1, the present integrated magnetic power converter core is illustrated, and is generally identified by the numeral 10. Integrated magnetic power converter core 10 combines a transformer and inductor device in a single magnetic structure of magnetic material. Core 10 includes a first leg 12 and a second leg 14. Core 10 may be shaped, for example, in the form of a toroid. Legs 12 and 14 are interconnected by magnetic material 16 and 18 to form a continuous magnetic conducting path around a window 20. Leg 12 of core 10 includes a primary winding 24 and a first secondary winding 26. Leg 14 of core 10 includes a second secondary winding 28.

An important aspect of the present invention is that the cross-sectional area of leg 12 is greater than the cross-sectional area of leg 14 of core 10. In this manner, the most efficient use of the magnetic material is achieved. The flux in core 10 is not the same from point to point at any given time because of the leakage flux which exists between leg 12 and leg 14. Any magnetic material has a maximum flux density beyond which the material loses its magnetic properties. The flux density at any point in the core must not exceed the maximum flux density value at any time for proper circuit operation. Core 10 therefore exhibits the optimum use of material such that legs 12 and 14 have sufficient cross-sectional area at every point to accommodate the maximum flux at that point and not exceed the material maximum flux density. Since the flux varies from point to point in core 10, the cross-sectional area of core 10 also varies.

Figure 2:
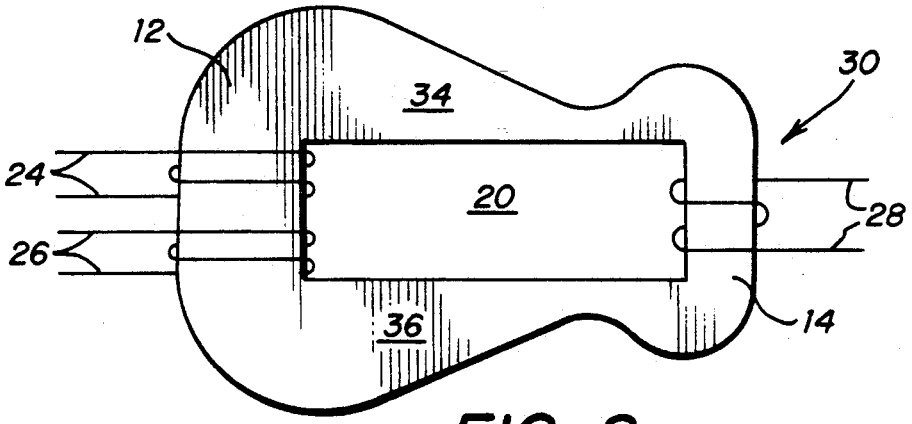
FIG. 2 is a schematic diagram of a second embodiment of the present integrated magnetic power converter core.
Figure 3:
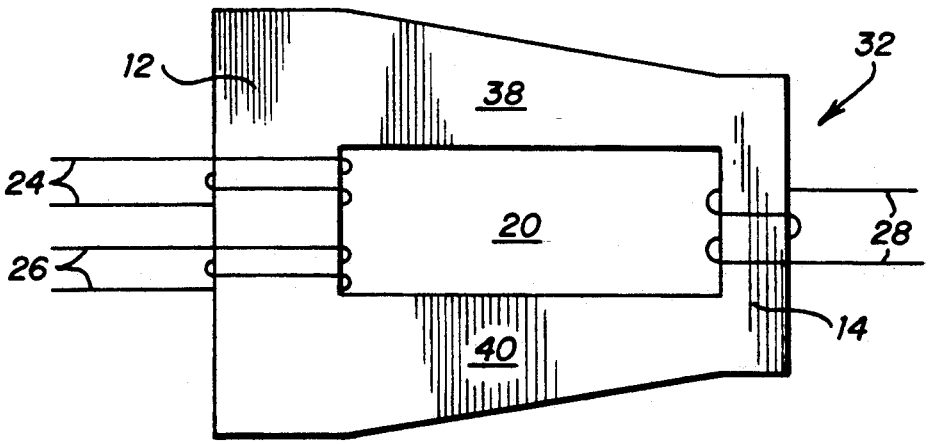
FIG. 3 is a schematic diagram of a third embodiment of the present integrated magnetic power converter core.

By measuring the flux density around the edge of window 20 of core 10, core material can be removed where not needed. FIGS. 2 and 3 illustrate additional embodiments of the present core, which are generally identified by the numerals 30 and 32, respectively. Like numerals are utilized for like and corresponding components identified with respect to FIG. 1. Core 30 includes magnetic material 34 and 36 which interconnects legs 12 and 14. The minimal cross-sectional area of materials 34 and 36 is less than the cross-sectional area of leg 14. Core 32 includes magnetic material 38 and 40 which interconnects legs 12 and 14. The cross-sectional area of magnetic material 38 and 40 linearly increase between the value of the cross-sectional area of leg 14 to the value of the cross-sectional area of leg 12. The configurations of cores 30 and 32 are optimized for both AC and DC flux levels around the magnetic flux conducting path.

Cores 10, 30 and 32 may be utilized as a core for an integrated magnetic power converter such as, for example, the converter described in U.S. Pat. No. 4,858,093 issued to Clayton L. Sturgeon on Aug. 15, 1989, and entitled "Integrated Magnetic Power Converter", which description is incorporated herein by reference.

It therefore can be seen that the present integrated magnetic power converter core constitutes a two bobbin, single window core which makes the optimum use of the available magnetic material throughout the flux conducting path.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A core for an integrated magnetic power converter comprising:

a continuous magnetic structure having first, second, third and fourth legs and a magnetic flux conducting path therebetween;

a primary winding means wound on said first leg;

first secondary winding means wound on said first leg;

second secondary winding means wound on said second leg;

said first leg having a first cross-sectional area and said second leg having a second cross-sectional area, said first cross-sectional area being greater than said second cross-sectional area;

said third and fourth legs disposed parallel to each other and perpendicular to said first and second legs forming a rectangular shaped window;

said third and fourth legs adjacent said first leg having a cross-sectional area substantially equal to said first cross-sectional area of said first leg and said third and fourth legs adjacent said second leg having a cross-sectional area substantially equal to said second cross-sectional area of said second leg; and said third and fourth legs between said first and second legs having a continuously variable cross-sectional area in the range between the values of said first and said second cross-sectional areas.

* * * * *